US007891039B2

(12) United States Patent
Lin

(10) Patent No.: US 7,891,039 B2
(45) Date of Patent: Feb. 22, 2011

(54) CLEANING APPARATUS WITH FAST WRINGING ABILITY

(76) Inventor: Ming-Hsien Lin, No. 13, Hun Yi St., Pu Tzi Chen Ind Dist, Chia Yi Hsien (TW)

( * ) Notice: Subject to any disclaimer, the term of this patent is extended or adjusted under 35 U.S.C. 154(b) by 765 days.

(21) Appl. No.: 11/901,558

(22) Filed: Sep. 18, 2007

(65) Prior Publication Data

US 2009/0070950 A1 Mar. 19, 2009

(51) Int. Cl.
*A47L 13/142* (2006.01)

(52) U.S. Cl. ..... 15/120.1; 15/119.1

(58) Field of Classification Search ..... 15/120.1, 15/120.2, 119.1
See application file for complete search history.

(56) References Cited

U.S. PATENT DOCUMENTS 1,499,684 A * 7/1924 Nolet ..... 15/120.2
1,520,500 A * 12/1924 Jumonville ..... 15/120.2
2,230,101 A * 1/1941 Bakemeier ..... 15/120.2
5,509,163 A * 4/1996 Morad ..... 15/120.2
5,566,417 A * 10/1996 Hsieh ..... 15/120.2
5,890,253 A * 4/1999 Morad ..... 15/120.1
6,058,549 A * 5/2000 Milward-Bason ..... 15/120.1
6,212,728 B1 * 4/2001 Facca et al. ..... 15/120.2
6,240,589 B1 * 6/2001 Specht ..... 15/120.2
6,615,437 B1 * 9/2003 Chow ..... 15/120.1
2007/0186363 A1 * 8/2007 Chiang ..... 15/120.1
2007/0226929 A1 * 10/2007 Kao ..... 15/120.1

* cited by examiner

*Primary Examiner*—Randall Chin
(74) *Attorney, Agent, or Firm*—Pro-Techtor Int'l Services; Ralph Willgohs

(57) ABSTRACT

A cleaning apparatus comprises a main rod, a wringing tube, a bearing, a lock, and a cleaning rag assembly. The wringing tube is coaxially put over the main rod and is glidingly movable along the main rod. The fastening device is mounted on the lower end of the main rod. The cleaning rag assembly surrounds a periphery of the main rod at a lower end thereof, having an upper end held by a connecting ring, which is mounted on the wringing tube, and a lower end mounted on the fastening device, allowing easily to replace the cleaning rag assembly.

10 Claims, 6 Drawing Sheets

CLEANING APPARATUS WITH FAST WRINGING ABILITY

FIELD OF THE INVENTION

The present invention relates to a cleaning apparatus, particularly to a cleaning apparatus having a wiping cloth made of several absorbent strips which is quickly mounted, dismounted and wrung.

BACKGROUND OF THE INVENTION

In daily life, cleaning apparatuses with handles are important tools for cleaning. A cleaning apparatus with handle generally has a handle and a cleaning element, which is a bundle of cotton strings held together by a wire or a band or is a wiping cloth. The cleaning element is attached to a lower end of the handle and works by sucking in water which serves to dissolve dirt on an object to be cleaned. After wiping over the object to be cleaned, the cleaning element is manually wrung, which is laborious and unhygienic.

As shown in FIGS. 4-7, a conventional cleaning apparatus, as disclosed in U.S. patent application Ser. No. 11/585,451, comprises: a main rod 1 with lateral blocking holes 11, a unidirectional wheel 2, set on an upper section of the main rod 1; a wringing tube 3*a*, coaxially put over the main rod 1, being glidable against the main rod 1 and turnable against the main rod 1 in one direction, with a flange 30*a* being attached to a lower end of the wringing tube 3*a*; a bearing 4, fastened to the main rod 1 at a lower end thereof; a lock 5*a*, holding the lower end of the main rod 1 at a lower end of the bearing 4; a cleaning rag assembly 6; and a lever assembly 7. An opening 35 is cut into the wringing tube 3*a* close to the unidirectional wheel 2. The lock 5*a* is inserted into the main rod 1 on a lower end thereof and held there by a holding assembly 50*a*, which comprises a helical spring 51*a* carrying two blocking heads 52*a* on opposite ends, which engage with the blocking holes 11. Furthermore, the lock 5*a* on a lower end thereof has a flange 57*a*. The cleaning rag assembly 6 comprises a cleaning rag 61, which is shaped like a tube, an upper holder 62 and a lower holder 63. The upper holder 62 is attached to the cleaning rag 61 at an upper end thereof and fastened to the flange 30*a* of the wringing tube 3*a*. The lower holder 63 is attached to the cleaning rag 61 at a lower end thereof and inserted into the lock 5*a* from below, being fastened to the flange 57*a*. For replacing the cleaning rag assembly 6, the blocking heads 52*a* are pushed inwards to disengage from the blocking holes 11. The lever assembly 7, passing through the opening 35, is engaged with the unidirectional wheel 2. The lever assembly 7 comprises a lever 71, having an inner end carrying a blocking tooth 72, a lateral hole 73 in a central position through which an axis 74 passes, and a projection 75 at an outer end, with a spring 76 being inserted between the projection 75 and a base 77 fixed on the wringing tube 3*a* below the opening 35.

By turning the wringing tube 3*a* against the main rod 1, the cleaning rag 61 is wrung dry effectively. Furthermore, the cleaning rag assembly 6 is easily replaced. However, during replacing of the cleaning rag assembly 6 using a tool, the cleaning rag 61 is often damaged. Besides, due to a relatively small diameter of the main rod 1, the wringing tube 3*a* has to be turned several times around the main rod 1 before a wringing effect ensues.

SUMMARY OF THE INVENTION

It is an object of the present invention to provide a cleaning apparatus having a cleaning element that is quickly and easily mounted and dismounted.

It is another object of the invention to provide a cleaning apparatus having a cleaning element that is quickly and easily wrung.

For achieving above objects, the present invention comprises a main rod, a wringing tube, a fastening device, and a cleaning rag assembly. The wringing tube is coaxially put over the main rod and is glidingly movable along the main rod. The fastening device is mounted on the lower end of the main rod. The cleaning rag assembly surrounds a periphery of the main rod at a lower end thereof, having an upper end held by a connecting ring, which is mounted on the wringing tube, and a lower end mounted on the fastening device, allowing easily to replace the cleaning rag assembly.

Other aspects and advantages of the present invention will become apparent from the following detailed description, taken in conjunction with the accompanying drawings, illustrating by way of example the principles of the present invention.

DESCRIPTION OF THE PREFERRED EMBODIMENTS

Figure 1:
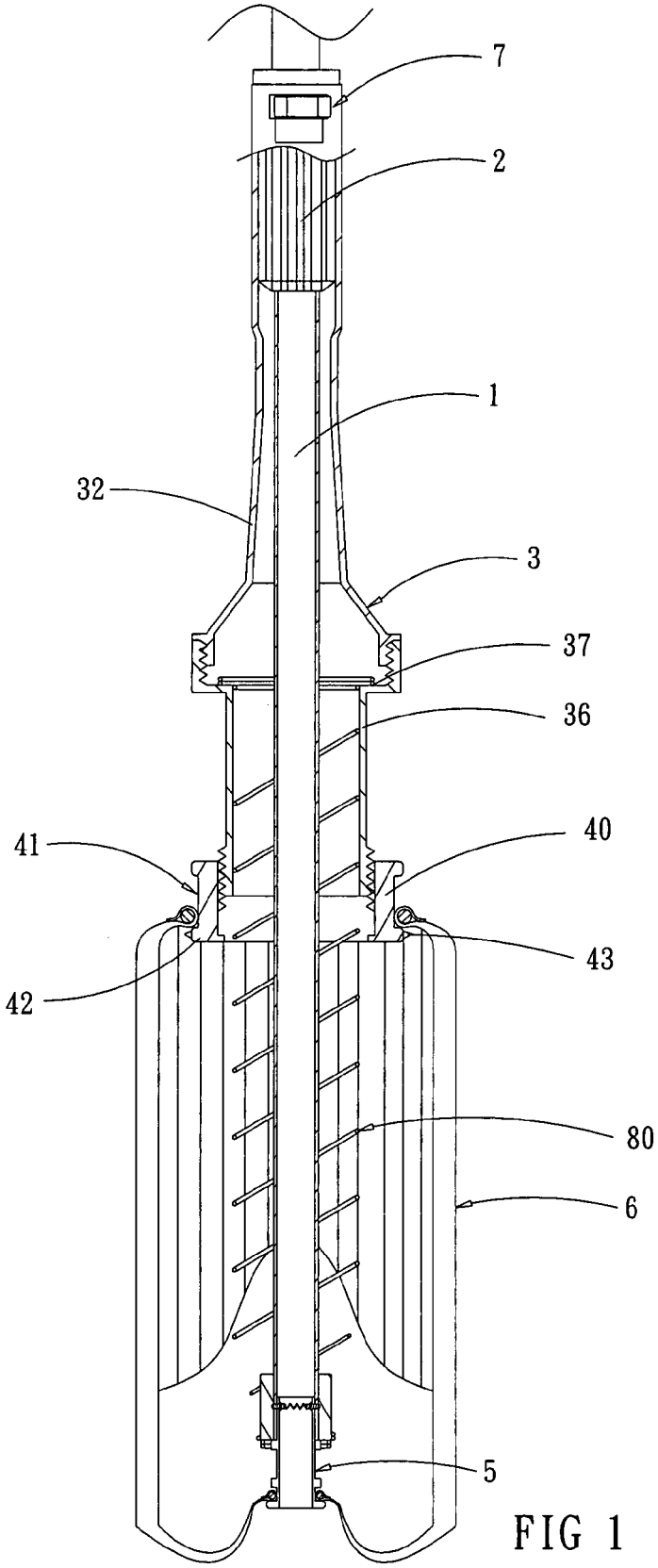
FIG. 1 is a side view of the cleaning apparatus of the present invention, with structural parts partly removed.
Figure 2:
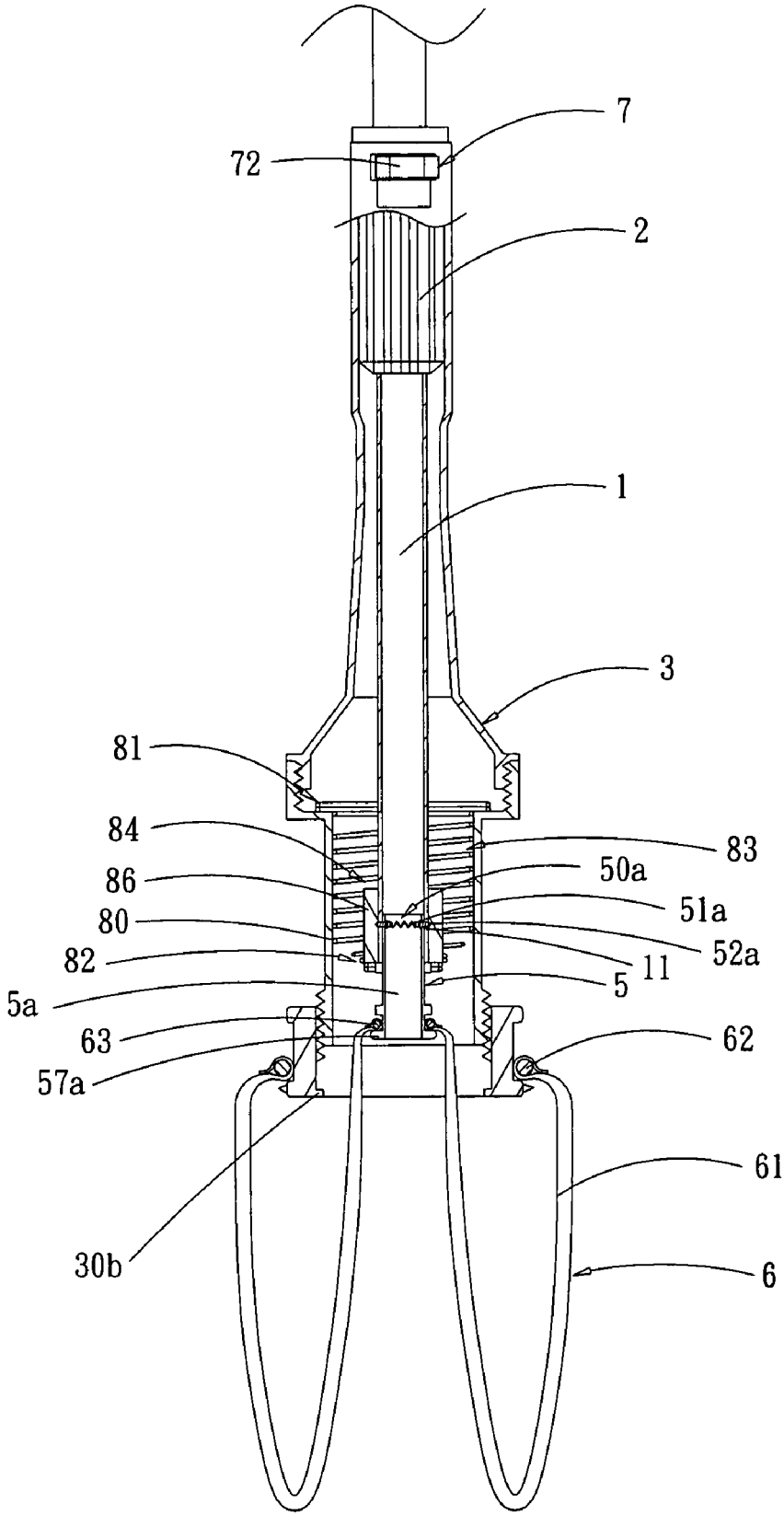
FIG. 2 is a schematic illustration of the movement of pulling up the main rod against the wringing tube of the present invention.

As shown in FIGS. 1-2, the cleaning apparatus of the present invention comprises: a main rod 1 with lateral blocking holes 11 at a lower end thereof, a unidirectional wheel 2; a wringing tube 3; and a cleaning rag assembly 6. The cleaning rag assembly 6 has an upper end, which carries a connecting ring 40, and a lower end, to which a fastening device 5 is attached, which in turn is mounted on the lower end of the main rod 1. A guiding device 80 surrounds the main rod 1, facilitating wringing of the cleaning rag assembly 6. In the following, a detailed description is given:

The cleaning rag assembly 6 comprises a cleaning rag 61, which is shaped like a tube and has a plurality of strips of water-absorbing material, an upper holder 62 and a lower holder 63. The upper holder 62 is attached to the cleaning rag 61 at an upper end thereof and fastened to a lower end of the wringing tube 3. The lower holder 63 is attached to the cleaning rag 61 at a lower end thereof and inserted into the fastening device 5 from below.

The fastening device 5 comprises a lock 5*a* and a flange 57*a*, to which the cleaning rag 61 at the lower end thereof is fastened. The lock 5*a* has a holding assembly 50*a*, which comprises a helical spring 51*a* carrying two blocking heads 52*a* on opposite ends, which engage with the blocking holes 11 at the lower end of the main rod 1. Thereby the cleaning rag assembly 6 is quickly and easily mounted and dismounted.

The wringing tube 3 has a handle 32 for manual turning thereof. A lever assembly 7 having a blocking tooth 72 allows turning of the tube 3 in only one direction, so as to wring the cleaning rag 61 effectively with little physical effort. A fastening tube 36 is attached to a lower end of the wringing tube 3, with a shoulder 37 placed in between, to which the guiding device 80 is fastened.

The connecting ring 40 is screwed on the lower end of the fastening tube 36. The connecting ring 40 has a peripheral groove 41, into which the upper holder 62 of the cleaning rag assembly 6 is inserted. A flange 42 forms a lower side of the peripheral groove 41, carrying peripheral teeth 43 for holding the cleaning rag assembly 6.

The handle 32 and the fastening tube 36 of the wringing tube 3 carry a thread for screwing on the connecting ring 40, which is oriented in a way that turning the wringing tube 3 of wringing the cleaning rag 61 will not loosen the connecting ring 40.

The guiding device 80 is longitudinally compressible, surrounding the main rod 1 at a distance 84, so that the wringing tube 3 requires a reduced number of turns for wringing the cleaning rag 61. The wringing tube 3 is vertically movable against the main rod 1. During wringing, the cleaning rag assembly 6 enters gaps 83 in the guiding device 80, and water that has been squeezed out flows away due to the distance 84 and is not re-absorbed by the cleaning rag 61.

The guiding device 80 comprises a vertical helical spring inside the fastening tube 36 with an upper plate 81, which is fastened on the shoulder 37, and a lower end, which carries a holding ring 82. A blocking sleeve 86 surrounds the main rod 1 at a certain vertical position. The holding ring 82 is rotatable around the main rod 1 and placed inside the blocking sleeve 86.

For increased stability, the guiding device 80 is vertically guided by an inner flange 30*b* inside the wringing tube 3 close to the lower end thereof.

Referring to FIG. 2, for using the cleaning apparatus of the present invention, the main tube 1 is manually pulled up against the wringing tube 3, so that the fastening device 5 and the lower end of the cleaning rag assembly 6 enter the wringing tube 3 from below, being held there by friction. In that state, a floor is cleaned, while the blocking sleeve 86 is placed between the main rod 1 and the fastening tube 32 of the wringing tube 3, ensuring stability thereof against inclination.

Figure 3:
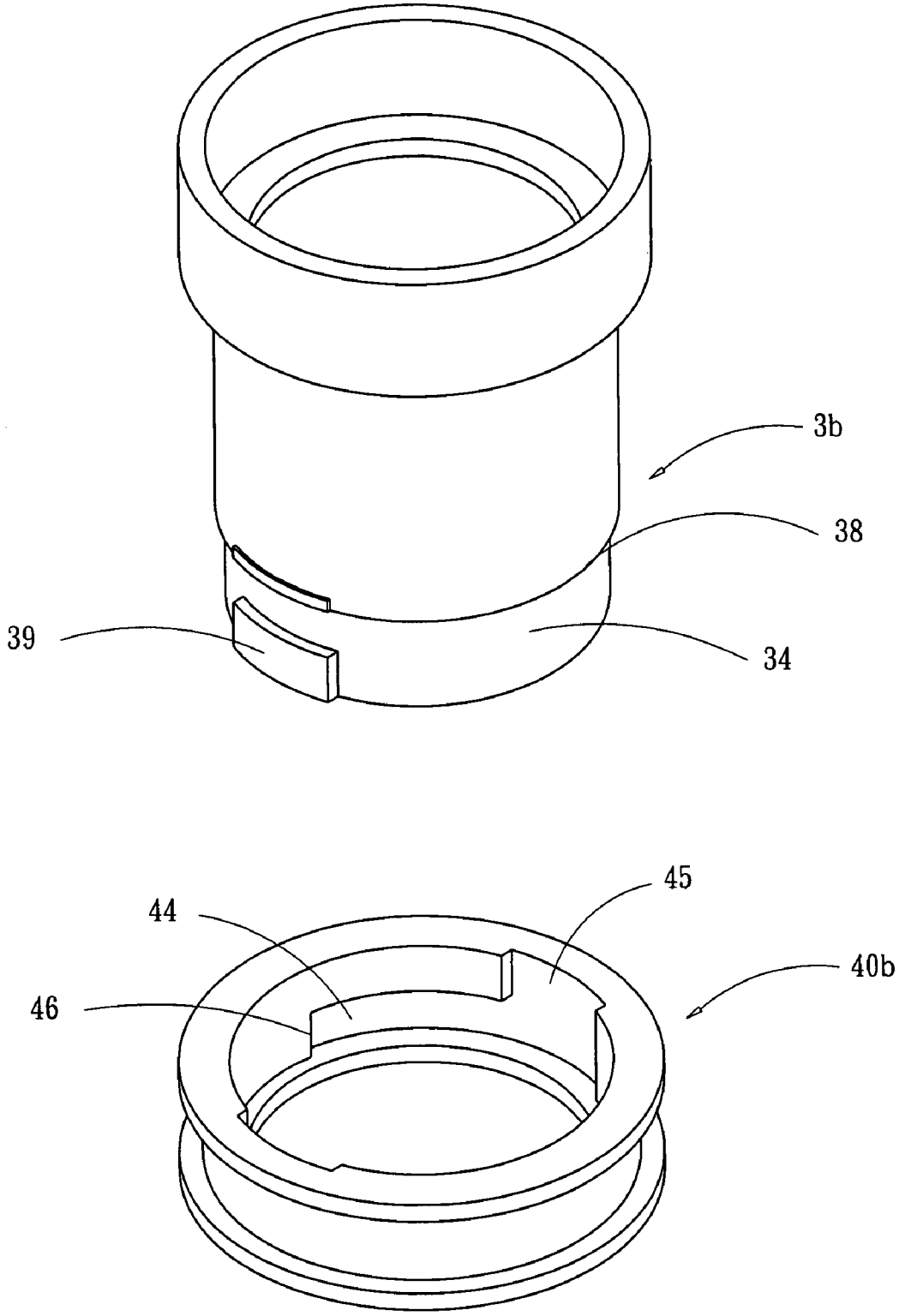
FIG. 3 is a perspective view of the wringing tube and the connecting ring of the present invention in another embodiment.
Figure 4:
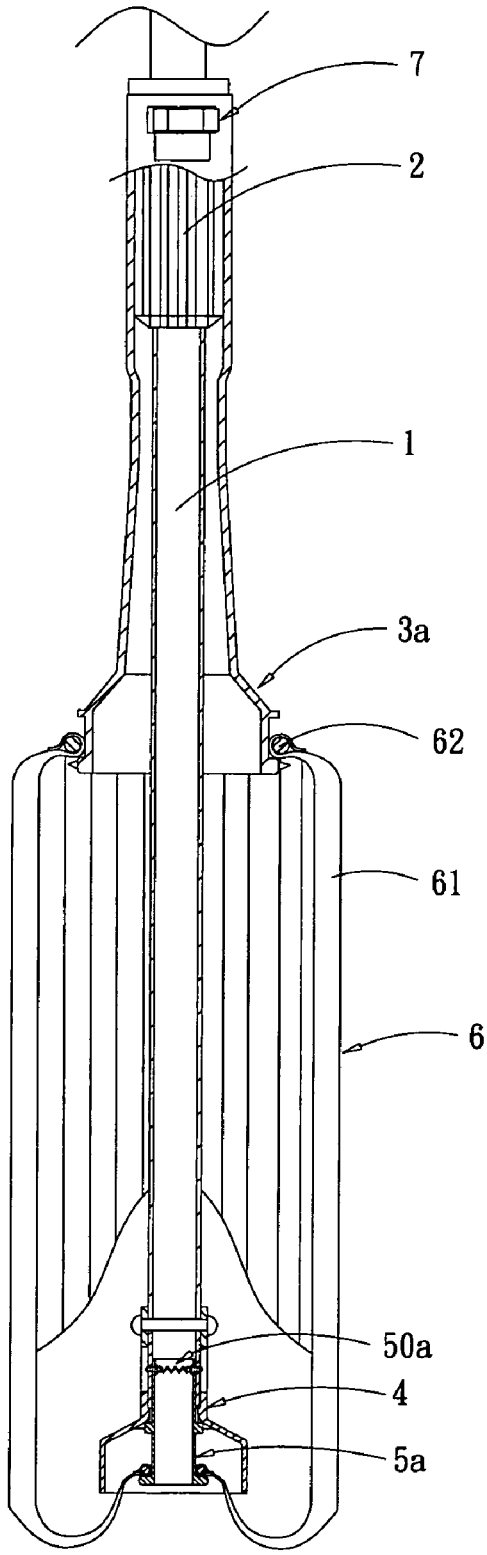
FIG 4(PRIOR ART)
FIG. 4 is a side view of a conventional cleaning apparatus, with structural parts partly removed.
Figure 5:
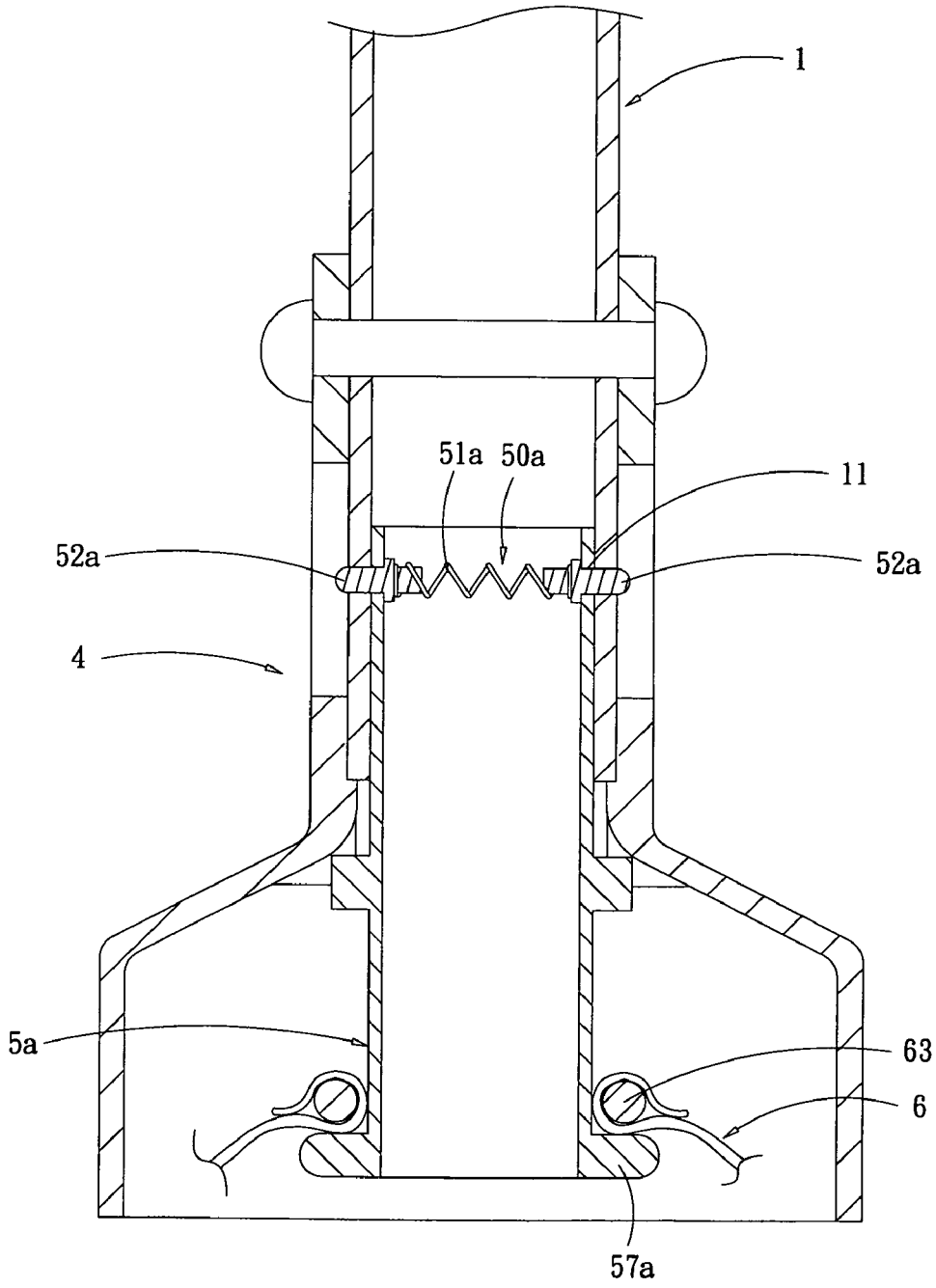
FIG 5(PRIOR ART)
FIG. 5 is a longitudinal sectional view of the bearing and the lock of a conventional cleaning apparatus.
Figure 6:
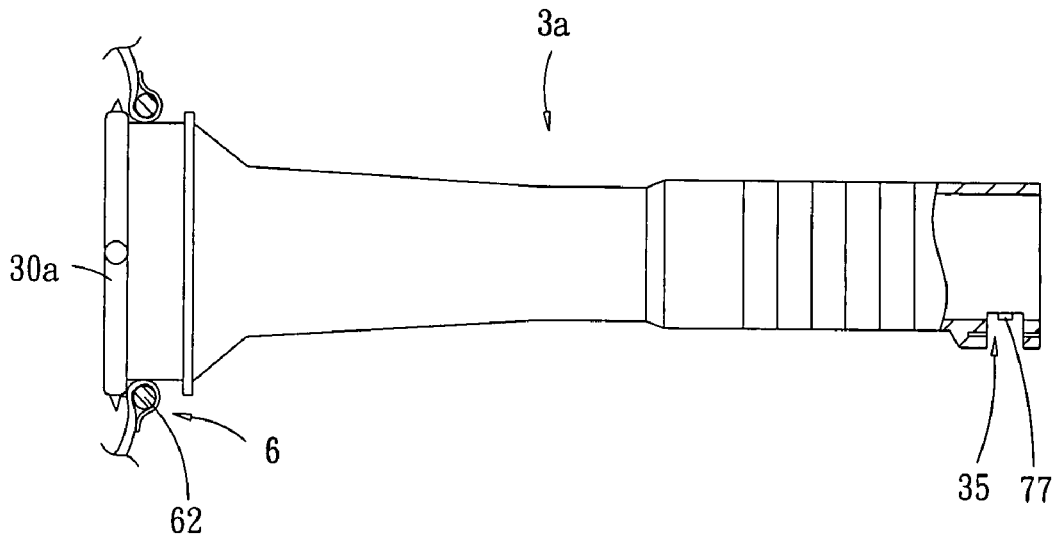
FIG 6(PRIOR ART)
FIG. 6 is a side view of the wringing tube of a conventional cleaning apparatus.
Figure 7:
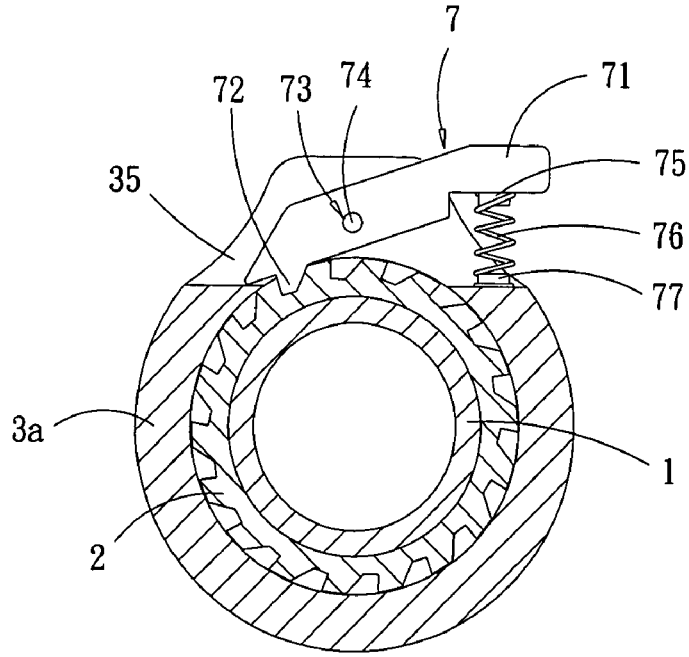
FIG 7(PRIOR ART)
FIG. 7 is a top view of the unidirectional wheel and the lever assembly of a conventional cleaning apparatus.

Referring to FIG. 3, for easier disassembling the present invention in a second embodiment has a connecting ring 40*b* with an inner periphery, into which an L-shaped depression 44 is cut. The depression 44 comprises an entry part 45 and a blocking part 46. Correspondingly, a wringing tube 3*b* has an insertion ring 34 with a relatively small diameter at a lower end thereof, with a shoulder 38 placed in between. The insertion ring 34 has a periphery with a projection 39. For mounting the connecting ring 40*b*, the connecting ring 40*b* is set on the insertion ring 34, with the projection 39 entering the entry part 45, and subsequently turned, so that the projection 39 enters the blocking part 36 and is held there. Then the connecting ring sits immediately on the shoulder 38. Alternatively, the connecting ring 40*b* has at least two depressions 44, and the wringing tube 3*b* has at least two corresponding projections 39.

The connecting ring 40*b* and the wringing tube 3*b* are preferably made of plastics with elasticity for holding the projection 39 in the depression 44.

The depression 44 is shaped in a way that turning the wringing tube 3 for wringing presses the projection deeper into the blocking part 36.

The invention claimed is:

1. A cleaning apparatus, comprising:

a main rod;

a wringing tube, coaxially put over said main rod and being glidingly movable along said main rod, furthermore being turnable against said main rod in a wringing direction; a fastening device, mounted on a lower end of said main rod; and a cleaning rag assembly, surrounding a periphery of said main rod at said lower end thereof, having an upper end held by a connecting ring, which is mounted on said wringing tube, and a lower end mounted on said fastening device, allowing easily to replace said cleaning rag assembly; wherein said connecting ring is screwed on a lower end of said wringing tube;

further comprising a unidirectional wheel and a lever assembly, mounted on an upper end of said wringing tube and having a blocking tooth, so that said wringing tube is turnable against said main rod in said wringing direction only, wherein upon turning said wringing tube in said wringing direction said connecting ring is screwed tighter thereon.

2. The cleaning apparatus according to claim 1, wherein said connecting ring has an L-shaped depression with an entry part and a blocking part and said wringing tube has an insertion ring carrying a projection, wherein, for mounting said connection ring on said wringing tube, said projection enters said entry part and then, after turning said wringing tube against said connecting ring in a mounting direction, said blocking part of said depression.

3. The cleaning apparatus according to claim 2, wherein said connecting ring and said wringing tube are preferably made of plastics with elasticity for holding said projection in said depression.

4. The cleaning apparatus according to claim 2, wherein said insertion ring has a smaller diameter than said wringing tube, so that said connecting ring after mounting is set on a shoulder thereof.

5. The cleaning apparatus according to claim 2, further comprising a unidirectional wheel and a lever assembly, mounted on an upper end of said wringing tube and having a blocking tooth, so that said wringing tube is turnable against said main rod in said wringing direction only, with said mounting direction and said wringing direction being equal.

6. The cleaning apparatus according to claim 1, wherein said connecting ring has at least two L-shaped depression with an entry part and a blocking part and said wringing tube has an insertion ring carrying at least two projections, wherein, for mounting said connection ring on said wringing tube, said projections respectively enter said entry parts and then, after turning said wringing tube against said connecting ring in a mounting direction, said blocking parts of said depressions.

7. The cleaning apparatus according to claim 6, wherein said connecting ring and said wringing tube are preferably made of plastics with elasticity for holding said projection in said depression.

8. The cleaning apparatus according to claim 6, wherein said insertion ring has a smaller diameter than said wringing tube, so that said connecting ring after mounting is set on a shoulder thereof.

9. The cleaning apparatus according to claim 6, further comprising a unidirectional wheel and a lever assembly, mounted on an upper end of said wringing tube and having a blocking tooth, so that said wringing tube is turnable against said main rod in said wringing direction only, with said mounting direction and said wringing direction being equal.

10. The cleaning apparatus according to claim 1, wherein said fastening device comprises a lock, which has an upper end with an elastic holding assembly having a helical spring and two insertion heads at opposite ends thereof, which respectively enter blocking holes of said main rod, and a flange mounted on a lower end of said lock for holding a lower end of said cleaning rag.

* * * * *